US011330941B1

(12) United States Patent
Tottenham

(10) Patent No.: US 11,330,941 B1
(45) Date of Patent: May 17, 2022

(54) MUSICAL TIMER TRAINING-TOILET FOR CHILDREN

(71) Applicant: Chauncia Tottenham, Webster, TX (US)

(72) Inventor: Chauncia Tottenham, Webster, TX (US)

( * ) Notice: Subject to any disclaimer, the term of this patent is extended or adjusted under 35 U.S.C. 154(b) by 0 days.

(21) Appl. No.: 17/081,313

(22) Filed: Oct. 27, 2020

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS 5,518,405 A * 5/1996 Aiello ..... G09B 19/00 434/258
5,781,939 A * 7/1998 Bledsoe ..... A47K 11/04 4/449
6,038,711 A * 3/2000 Clarke ..... A47K 11/04 4/449
7,237,278 B1 * 7/2007 Scott ..... A47K 13/24 4/483
7,865,980 B1 * 1/2011 Fuller ..... A47K 11/06 4/483
7,891,030 B1 * 2/2011 Sutton ..... A47K 11/06 4/483
9,715,836 B2 * 7/2017 Berkovich ..... A47K 13/06

* cited by examiner

*Primary Examiner* — Huyen D Le

(57) ABSTRACT

A specially designed potty chair having interactive features including a timer that ensures the child will remained seated for an adequate amount of time, as well as which congratulate and reward the child upon using the facilities. The Musical Timer Training Potty may also feature an attachable activity tray that will entertain the child when seated. Design intent is to provide a simple and effective means of potty training infants and toddler children by providing positive reinforcement and entertainment that encourages the child in proper use of the potty.

10 Claims, 2 Drawing Sheets

MUSICAL TIMER TRAINING-TOILET FOR CHILDREN

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of toilets and more specifically relates to a musical timer training-toilet for children.

2. DESCRIPTION OF THE RELATED ART

Teaching a child to use a toilet, commonly called toilet training or potty training, is often a trying time for both the parent and the toddler. Coaching a child in the use of the toilet, encouraging them when they have the occasional "accident," and wiping away tears when a child gets frustrated are but a few of the many occurrences, experienced by parents or caregivers of potty training toddlers.

Most caregivers agree that the first step to potty training involves purchasing a small training-toilet, often referred to as a "potty seat." Similar in function to a standard toilet, potty seats are scaled appropriately for use by toddlers and typically feature a removable bowl for easy cleaning and maintenance. Although such potty seats are practical items, encouraging a child to actually sit on the potty seat long enough to use the facilities can be extremely difficult. As many parents and professionals would attest, most toddlers have relatively short attention spans. Because of this, sitting in the same place for extended periods, without squirming or attempting to get up, can be a daunting task for many little ones. Many times a child will get up from the potty before they have actually urinated or passed a bowel movement, causing frustration to the caregiver and child alike. Part of the problem, aside from this inability to sit still, is that young children find a seeming lack of purpose to sitting on the potty seat when nothing happens immediately, making the task of potty training a child that much harder. An effective and entertaining means to achieve more efficient potty training is desirable.

Various attempts have been made to solve problems found in potty art. Among these are found in: U.S. Pub. No. 2003/0123330 to Susie L. Carter et al.; U.S. Pat. No. 5,518,405 to Marianna C. Aiello; and U.S. Pat. No. 5,008,964 to Janet C. Dean et al. This prior art is representative of potties. None of the above inventions and patents, taken either singly or in combination, is seen to describe the invention as claimed.

Ideally, a musical timer training-toilet for children should provide a suitably sized potty seat for toddlers and young children, with a musical timer to indicate how long the child needs to remain seated, and, yet would operate reliably and be manufactured at a modest expense. Thus, a need exists for a reliable musical timer training-toilet for children to avoid the above-mentioned problems.

BRIEF SUMMARY OF THE INVENTION

In view of the foregoing disadvantages inherent in the known toilet art, the presently claimed invention provides a novel musical timer training-toilet for children. The general purpose of the present invention, which will be described subsequently in greater detail is to provide a suitably sized potty seat for toddlers and young children, with a musical timer to indicate how long the child needs to remain seated and a way of congratulating and rewarding the child upon the child using the facilities.

The Musical Timer Training Potty may also feature an attachable activity tray that will entertain the child when seated. Design intent is to provide a simple and effective means of potty training infants and toddler children by providing positive reinforcement and entertainment that encourages the child in proper use of the training toilet.

The presently claimed invention holds significant improvements and serves as a musical timer training-toilet for children. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention that are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures that accompany the written portion of this specification illustrate embodiments and method(s) of use for the present invention, a musical timer training-toilet for children, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the presently claimed invention relate to a training toilet for young children and more particularly to a musical timer training-toilet for children as used to improve the process of teaching a toddler to use a toilet.

Generally speaking, the musical timer training-toilet is a specially designed training-toilet seat developed specifically to capture a child's attention by entertaining and rewarding the child during use of the facilities, thus reinforcing the desire to use the toilet in the child and facilitating quick and efficient potty training.

Figure 1:
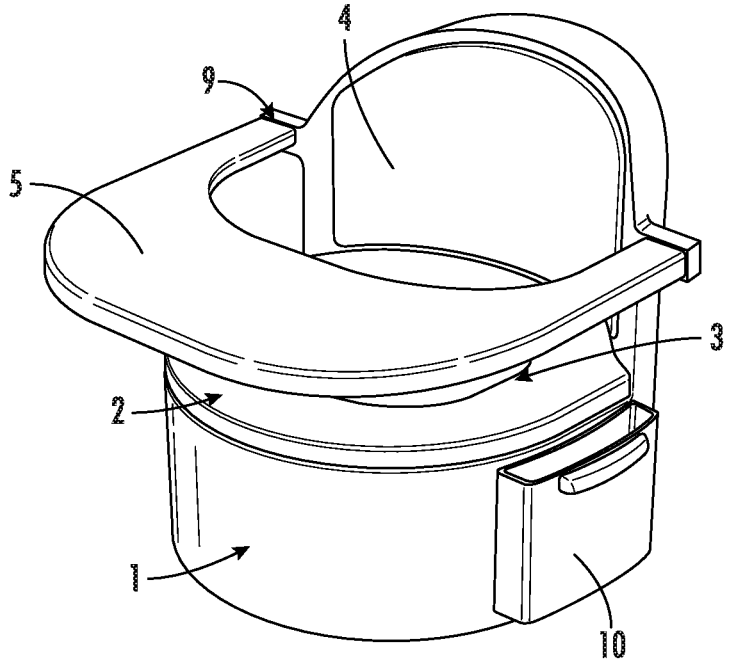
FIG. 1 shows a front perspective view illustrating a musical timer training-toilet for children according to an embodiment of the present invention.
Figure 2:
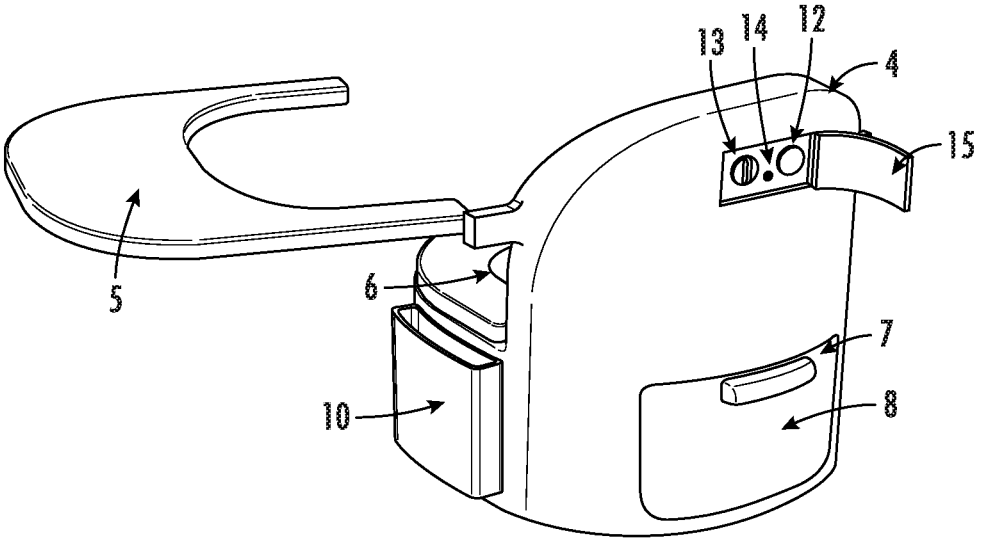
FIG. 2 is a rear perspective view illustrating the musical timer training-toilet for children according to an embodiment of the present invention.
Figure 3:
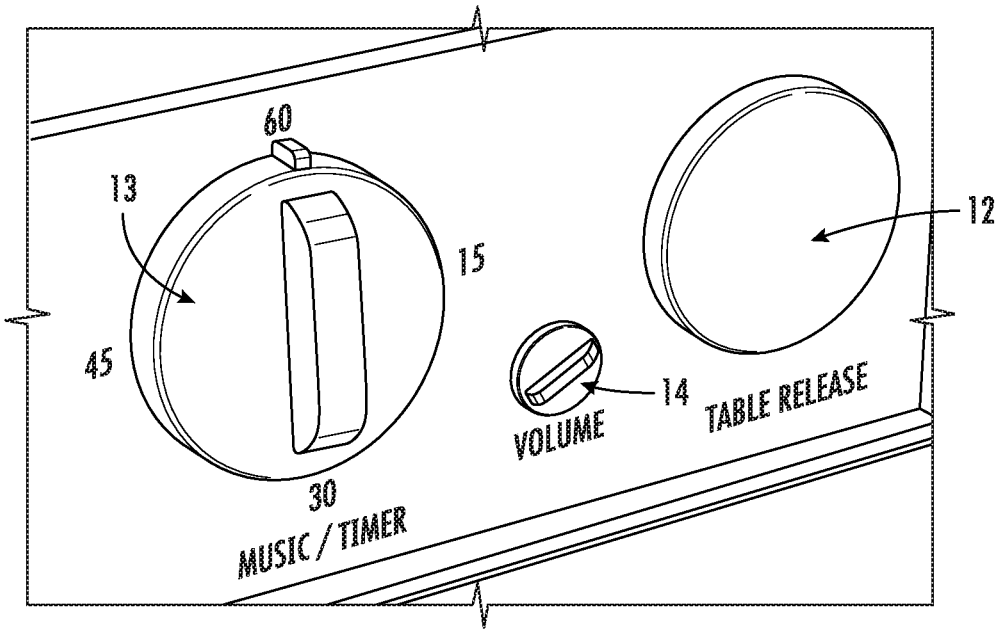
FIG. 3 is a close-up perspective view illustrating components of the musical timer training-toilet for children according to an embodiment of the present invention.

Referring now to FIGS. 1-3, the musical timer training-toilet is similar in general design and basic function to a standard toilet seat, but with many unique and novel features added to promote the function described herein. The musical timer training-toilet has a hollow body 1 that may be square-shaped or circular-shaped, or square-shaped with rounded edges. The hollow body 1 has a flat base designed to rest directly on the ground, and an open top. The hollow body 1 has a seat 2 above with a central hole 3. The seat 2 is preferably a cushioned seat. The hollow body 1 also has a back section 4 and a moveable table-arm 5, both of which are contoured so as to be integrated with the hollow body 1. The back section 4 is preferably a padded back. The musical timer training-toilet is manufactured of a durable yet light-weight plastic or a comparable material.

The cushioned seat 2 of the musical timer training-toilet is preferably oval-shaped and positionable directly over a circle-shaped, removable bowl 6 that rests within the hollow body 1. The hollow body 1 has a bowl opening 7, preferably located in a back side of the body 1, to provide parents and caregivers a simple and sanitary method of removing the bowl 6 from within the hollow body 1 following use, as opposed to lifting it out from above. The bowl opening 7 is preferably covered by an access door 8, that contains the bowl 7 and prevents the bowl 7 from sliding out while in use.

For aesthetic purposes, this bowl 6 may be discreetly hidden beneath a hinged lid, similar to that of a regular toilet seat lid, when not in use. The musical timer training-toilet may be manufactured in an array of vibrant colors that may appeal to children. The potty chair may be configured in the form of popular cartoon characters such as those licensed by Disney®, Nickelodeon® and Mattel® for example.

The most notable aspect of the musical timer training-toilet is found in the uniquely designed interactive features that encourage the child to stay seated and use the facilities. Easily attachable to the front of the device and resting directly above the child's lap when seated is be a tray table arm 5 that is moveable via a hinge 9 and may be filled with activity toys, coloring books or other entertaining goods deemed appropriate by the parent or caregiver. This tray table 5 may be configured expressly to occupy and entertain the little one while they are on the training-toilet. The table arm 5 may optionally lock into place, to better keep the child on the seat, preventing the child from getting up before they have used the facilities. The table arm 5 lock can be released via a release button 12 located preferably on the back side of the padded back 4.

An ample storage pocket 10 is optionally built into a side of the musical timer training-toilet inside of which activity toys, coloring books and other accessories may be neatly housed and easily accessed. Most notably, an integrated timer mechanism 11 is mounted to the of the training-toilet, or more preferably on the back of the padded back 4 of the training-toilet, and may be set by the parent for intervals ranging between ten minutes and one hour. The timer mechanism 11 includes a speaker and programmable device with preloaded music thereon, and plays music for the duration of the time set on the timer to indicate to the child that it is "potty time", meaning that both the parent/guardian and child will understand that this is the time to go, all while being entertained and relaxed by the music. This timer 11 may be programmed to play any number of whimsical, kid-friendly songs, nursery rhymes or the like.

The timer 11 is powered by an internally-contained battery such as a standard 9 volt or D alkaline, located within the timer mechanisms 11. The timer mechanisms 11 include a timer setting button 13 to control the length of time the timer 11 is set for and a volume control button 14 to control the volume of the music. To prevent the child from easily reaching the buttons 12, 13, 14 and to improve aesthetics, the buttons 12, 13, 14 may be hidden behind a control panel door 15.

Use of the musical timer training-toilet is very simple and straight forward. The parent or caregiver positions the unit in a designated area within the home, such as the bathroom. To use the potty, the child may simply lift up the toilet seat, sitting down on the unit as they would any other potty chair. The parent or caregiver may then set the integrated timer mechanism for an amount of time deemed appropriate to encourage the child to use the facilities. The parent may then position the included tray table in front of the child, loading the table with toys, coloring books or other interactive activity items. Thus entertained via the music emitted by the timer, as well as the activity tray, the child may remain comfortably seated until they have eliminated waste. The caregiver may then assist the child out of the chair. The actual potty bowl may then be retrieved from the back of the unit and emptied, rinsed clean and placed back in the musical timer training-toilet until the potty is again needed.

The musical timer training-toilet may effectively encourage a child in the use of the toilet. A cleverly designed toilet seat boasting an integrated timer mechanism 11 and activity tray 5 that entertains the child via friendly music and interactive toys, books or games, the musical timer training-toilet may ensure that the little one remained seated until they have eliminated waste. Providing a fun and friendly way in which to encourage the child to stay seated atop the chair in order to earn their reward, the musical timer training-toilet may keep a child entertained and occupied for extensive periods, thus ensuring they stay on the potty until they have used the bathroom.

Because of this, a child who routinely use the musical timer training-toilet may effectively learn to use the potty in a faster, more efficient manner A learning tool, parents and caregivers should appreciate that with the musical timer training-toilet, their child may learn to associate the potty chair with its designated function, thus greatly reducing the "accidents" which so often occur when a child is potty trained. A sanitary alternative to traditional potty chairs, the musical timer training-toilet removable bowl 6 may be accessed from a panel 7, 8 at the back of the unit, as opposed to being lifted out from above. As such, the bowl 6 may be removed easily, vastly reducing the risk that one will spill waste from the bowl and onto themselves or surrounding flooring when cleaning the bowl following use. Portable, this cushiony soft potty seat may be easily packed for a family vacation, or even for an afternoon trip to Grandma's house. Although designed with general household use in mind, the musical timer training-toilet may be well suited for use in day care centers and similar establishments. Durably constructed of heavy duty materials, the musical timer training-toilet may be passed down from one child to the next, ensuring years of continual use.

Innovative and unique, the Musical Timer Training Potty is a practical product invention which may encourage any child in the transition from diapers to the potty. Simple to use and loaded with fun and exciting interactive features, this product may prove a convenient and valuable tool during the early stages of potty training.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A musical timer training-toilet for children comprising:

a. a hollow body having a flat base and an open top, wherein the hollow body has a bowl opening in a side of the hollow body;

b. a seat operably connected to the hollow body so as to rest along a rim of the open top, wherein the seat has a central hole therein that opens over the open top of the hollow body;

c. a back portion integrated along a back side of the hollow body to support a user's back when sitting;

d. a moveable table-arm, wherein the moveable table arm is operably connected to the hollow body or the back portion via a hinge so as to rotate between an open position and a locked position;

e. a removable bowl, wherein the removable bowl has an outer circumference that fits within an inner circumference of the hollow body so that the removable bowl fits within the hollow body and is removable and replaceable via the bowl opening;

f. an access door, wherein the access door is operably connected to the hollow body by one or more hinges so that the access door covers the bowl opening when in a closed position and exposes the bowl opening when in an open position;

g. a release button operably connected to the moveable table-arm so as to unlock the moveable table-arm from the locked position when pressed; and h. a musical timer mechanism operably mounted within the hollow body and having i. a timer;

ii. a speaker to play music;

iii. a programmable device with a memory; and iv. one or more pieces of music stored in the memory of the programmable device and playable on the speaker for the duration of a time set on the timer;

v. a timer setting button, wherein the timer setting button is operably connected to the timer so as to allow the user to set a duration of time; and vi. a volume control button, wherein the volume control button is operably connected to the speaker so as to allow the user to set a volume level the speaker.

2. The musical timer training-toilet for children according to claim 1, wherein the back portion is padded.

3. The musical timer training-toilet for children according to claim 1, wherein the seat is padded.

4. The musical timer training-toilet for children according to claim 1, wherein the hollow body, seat, back portion, and table-arm are manufactured from a durable, lightweight plastic.

5. The musical timer training-toilet for children according to claim 1, wherein the side of the hollow body the bowl opening is located in is a back side of the hollow body directly below the back portion.

6. The musical timer training-toilet for children according to claim 1, further comprising:

a seat lid operably connected to the hollow body by one or more hinges so that the seat lid covers the seat and central hole therein when in a closed position, and rests against the back portion, exposing the seat and central hole therein, when in an open position.

7. The musical timer training-toilet for children according to claim 1, further comprising:

a drawer opening in a side of the hollow body; and a slidable storage drawer operably located within the drawer opening so as to slide in and out of the drawer opening between an open position and a closed position.

8. The musical timer training-toilet for children according to claim 1, further comprising:

a control panel door, wherein the release button, the timer setting button, and the volume control button are positioned with a recess in a back side of the back portion so as to be out of easy reach of a child seated on the seat while still easily accessible by a caretaker, and wherein the control panel door is operably connected to the back portion via one or more hinges so that the control panel door covers the recess when in a closed position and exposes the recess when in an open position.

9. A musical timer training-toilet for children comprising:

a. a hollow body having a flat base and an open top, wherein the hollow body has a bowl opening in a back side of the hollow body;

b. a padded seat operably connected to the hollow body so as to rest along a rim of the open top, wherein the seat has a central hole therein that opens over the open top of the hollow body;

c. a padded back portion integrated along a back side of the hollow body to support a user's back when sitting;

d. a seat lid operably connected to the hollow body by one or more hinges so that the seat lid covers the seat and central hole therein when in a closed position, and rests against the back portion, exposing the seat and central hole therein, when in an open position e. a moveable table-arm, wherein the moveable table arm is operably connected to the hollow body or the back portion via a hinge so as to rotate between an open position and a locked position;

f. a removable bowl, wherein the removable bowl has an outer circumference that fits within an inner circumference of the hollow body so that the removable bowl fits within the hollow body and is removable and replaceable via the bowl opening;

g. an access door, wherein the access door is operably connected to the hollow body by one or more hinges so that the access door covers the bowl opening when in a closed position and exposes the bowl opening when in an open position;

h. a drawer opening in a side of the hollow body;

i. a slidable storage drawer operably located within the drawer opening so as to slide in and out of the drawer opening between an open position and a closed position j. a release button operably connected to the moveable table-arm so as to unlock the moveable table-arm from the locked position when pressed;

k. a musical timer mechanism operably mounted within the hollow body and having i. a timer;

ii. a speaker to play music;

iii. a programmable device with a memory; and iv. one or more pieces of music stored in the memory of the programmable device and playable on the speaker for the duration of a time set on the timer;

v. a timer setting button, wherein the timer setting button is operably connected to the timer so as to allow the user to set a duration of time; and vi. a volume control button, wherein the volume control button is operably connected to the speaker so as to allow the user to set a volume level the speaker; and l. a control panel door, wherein the release button, the timer setting button, and the volume control button are positioned with a recess in a back side of the back portion so as to be out of easy reach of a child seated on the seat while still easily accessible by a caretaker, and wherein the control panel door is operably connected to the back portion via one or more hinges so that the control panel door covers the recess when in a closed position and exposes the recess when in an open position.

10. The musical timer training-toilet for children according to claim 9, wherein the hollow body, seat, back portion, and table-arm are manufactured from a durable, lightweight plastic.

* * * * *